US007976297B2

(12) United States Patent
Okada

(10) Patent No.: US 7,976,297 B2
(45) Date of Patent: Jul. 12, 2011

(54) GEAR PUMP INCLUDING INTRODUCTION PATHS AND RETURN PATHS

(75) Inventor: Motohiro Okada, Otsu (JP)

(73) Assignee: Shimadzu Mectem, Inc., Shiga (JP)

( * ) Notice: Subject to any disclaimer, the term of this patent is extended or adjusted under 35 U.S.C. 154(b) by 416 days.

(21) Appl. No.: 12/159,037

(22) PCT Filed: Feb. 20, 2006

(86) PCT No.: PCT/JP2006/302987

§ 371 (c)(1),
(2), (4) Date: Jun. 24, 2008

(87) PCT Pub. No.: WO2007/096943

PCT Pub. Date: Aug. 30, 2007

(65) Prior Publication Data

US 2009/0311120 A1 Dec. 17, 2009

(51) Int. Cl.
*F03C 2/00* (2006.01)
*F03C 4/00* (2006.01)
*F04C 2/00* (2006.01)

(52) U.S. Cl. ..... 418/79; 418/76; 418/132; 418/201.1

(58) Field of Classification Search ..... 418/75, 418/76, 79, 80, 132, 201.1, 206.1, 206.6–206.8
See application file for complete search history.

(56) References Cited

U.S. PATENT DOCUMENTS

| | | | | | |
|---|---|---|---|---|---|
| 2,338,065 | A | * | 12/1943 | Ungar | 418/201.1 |
| 2,823,616 | A | * | 2/1958 | Toyoda | 418/79 |
| 2,997,960 | A | * | 8/1961 | Kimijima et al. | 418/79 |
| 3,833,319 | A | * | 9/1974 | Eglington | 418/132 |
| 4,090,820 | A | * | 5/1978 | Teruyama | 418/79 |
| 4,239,468 | A | * | 12/1980 | Smith | 418/132 |

FOREIGN PATENT DOCUMENTS

| | | | |
|---|---|---|---|
| JP | 53-024608 | A | 3/1978 |
| JP | 58-079086 | U | 5/1983 |
| JP | 02-013185 | U | 1/1990 |
| JP | 08-014165 | A | 1/1996 |
| JP | 9-144668 | A | 6/1997 |
| JP | 2000-186679 | A | 7/2000 |
| JP | 2000-265974 | A | 9/2000 |

* cited by examiner

*Primary Examiner* — Theresa Trieu
(74) *Attorney, Agent, or Firm* — Sughrue Mion, PLLC

(57) ABSTRACT

An intended purpose of this invention is to realize a gear pump suitable for delivery of high-pressure and high-viscosity fluids by using helical gears meshing with each other. For this purpose, the gear pump includes introduction paths for introducing the fluid from a discharge side toward shaft end sides of gear shafts to apply shaft ends of the gear shafts with fluid pressures counterbalancing axial thrusts produced by the helical gears.

10 Claims, 3 Drawing Sheets

GEAR PUMP INCLUDING INTRODUCTION PATHS AND RETURN PATHS

This application is the national phase under 35 U.S.C.§371 of PCT International Application No. PCT/JP2006/302987 which has an International filing date of Feb. 20, 2006, which designated the United States of America.

TECHNICAL FIELD

The present invention relates to a gear pump for use in delivering high-pressure and high-viscosity fluids in particular.

BACKGROUND ART

It is a general practice to use involute spur gears in a gear pump configured to move a fluid from a suction side toward a discharge side by rotation of the gears meshing with each other. This is because an involute tooth can be cut easily and allows measurement of its finished dimensions to be easily carried out, thereby making it possible to provide for a high precision gear.

On the other hand, the involute spur gears entail an adverse effect called "fluid confinement phenomenon". During rotation of the involute spur gears, there is a period during which two pairs of teeth mesh with each other to confine the fluid therebetween. The volume of the confinement region varies with rotation of the gears, thus bringing about an inconvenience such that when the confinement region is compressed, a rise in the pressure of the fluid confined and wasteful consumption of power occur, while when the confinement region is expanded, a vacuum or air bubbles are produced.

The adverse effect of the confinement phenomenon becomes more serious as the viscosity of the fluid being delivered, or the suction or discharge pressure of the pump increases. Therefore, it is difficult to employ the involute spur gears in a pump for use in delivering high-pressure and high-viscosity fluids, such as molten resin, with pressure.

The above-described confinement phenomenon can be avoided by employing helical gears with their helix angle adjusted appropriately. In addition, a helical gear pump fails to cause the pressure of the fluid being delivered to change steeply, offers relatively smooth gear engagement, and is capable of suppressing noise and vibration.

However, since the helical gears are subjected to the action of axial thrust (thrust force) during rotation, the side faces of the respective gears are strongly pressed against each other in the axial direction to cause friction, which sometimes results in seizure. For this reason, a double helical gear is usually used which is capable of canceling each other's axial thrust (see patent document 1 for example).

Such a double helical gear is not easy to form. As is often the case in actually manufacturing the double helical gear, two helical gears which are symmetric with each other are joined together to form one double helical gear. With such a manufacturing method, the gears and gear shafts cannot but be separate members. Accordingly, machining for forming keys, key ways and the like is needed to join the gears and the gear shafts with each other. What is more, the gears and the gear shafts have increased diametrical dimensions, which will lead to an increase in the size of the pump.

The present invention, which has been made in view of the foregoing, intends to realize a gear pump which is suitable for delivering high-pressure and high-viscosity fluids, without using a double helical gear.

Patent document 1: Japanese Patent Laid-Open Publication No. HEI 08-014165

DISCLOSURE OF INVENTION

According to the present invention, there is provided a gear pump for moving a fluid from a suction side toward a discharge side by rotation of helical gears meshing with each other, comprising introduction paths for introducing the fluid from the discharge side toward shaft end sides of gear shafts to apply shaft ends of the gear shafts with a fluid pressure counterbalancing axial thrusts produced by the helical gears. This construction can eliminate or reduce the adverse effect of the axial thrusts irrespective of the helix angle. Since a helix angle design freedom is secured, the helix angle can be set to an appropriate value in order to avoid the confinement phenomenon as well as to meet various specifications and conditions. Generally, the above-described construction makes it possible to realize a gear pump which is suitable for delivering high-pressure and high-viscosity fluids, by using helical gears.

When the gear pump further comprises a regulating valve for regulating a fluid pressure of the fluid passing through an associated one of the introduction paths, it is possible to apply a necessary and sufficient fluid pressure for canceling the axial thrust by regulating the fluid pressure by means of the regulating valve. This feature is particularly effective when the present invention is applied to a pump for delivering a non-Newtonian fluid with pressure. Because the apparent viscosity of such a non-Newtonian fluid varies with varying shear rate, the axial thrust that is estimated in the design stage often does not match the axial thrust that is actually produced. It is therefore difficult to predetermine the fluid pressure of the fluid introduced through the introduction path. For this reason, the pump desirably has the ability to regulate the fluid pressure during operation using a real fluid.

For the same reason as stated above, the gear pump preferably further comprises a pressure gauge for measuring the fluid pressure of the fluid passing through an associated one of the introduction paths.

When each of the helical gears and its associated gear shaft are formed into an integral product, the pump can be reduced in size. If a double helical gear is to be formed integrally with its associated gear shafts, there arise limitations imposed on the specifications of the gear by the manufacturing process and, hence, the specifications cannot be set to respective optimum values. Since the present invention employs not a double helical gear but helical gears, it is possible to form each of the helical gears integrally with its associated shaft easily and allow its helix angle to be adjusted to an optimum value.

The gear pump may have a feature that: return paths are provided for returning the fluid introduced to the shaft end sides through the introduction paths toward the suction side; and each of bearings supporting the gear shafts is formed with a slot in communication with an associated one of the return paths or an associated one of the introduction paths for allowing the fluid to flow into an inner periphery of the bearing for lubrication. With this feature, it is possible to bring the fluid pressure and the axial thrust into balance and lubricate each bearing at the same time.

The gear pump may include a casing comprising, as constituents thereof, a body having a bore extending therethrough axially of the gear shafts for accommodating the helical gears, the gear shafts and the bearings therein, and front and rear covers closing the body at front and rear sides thereof and each having an inside surface opposed to an associated shaft end of each of the gear shafts, wherein the inside surface of each of the front and rear covers is formed with an associated one of the introduction paths and an associated one of the return paths. This feature fails to incur too much complication of the pump structure. Further, this feature allows the regulating valve or the pressure gauge to be mounted on each of the front and rear covers, thereby contributing to simplification of the pump assembling process.

The present invention makes it possible to realize a gear pump which is suitable for delivering high-pressure and high-viscosity fluids, without using a double helical gear.

BEST MODE FOR CARRYING OUT THE INVENTION

Figure 1:
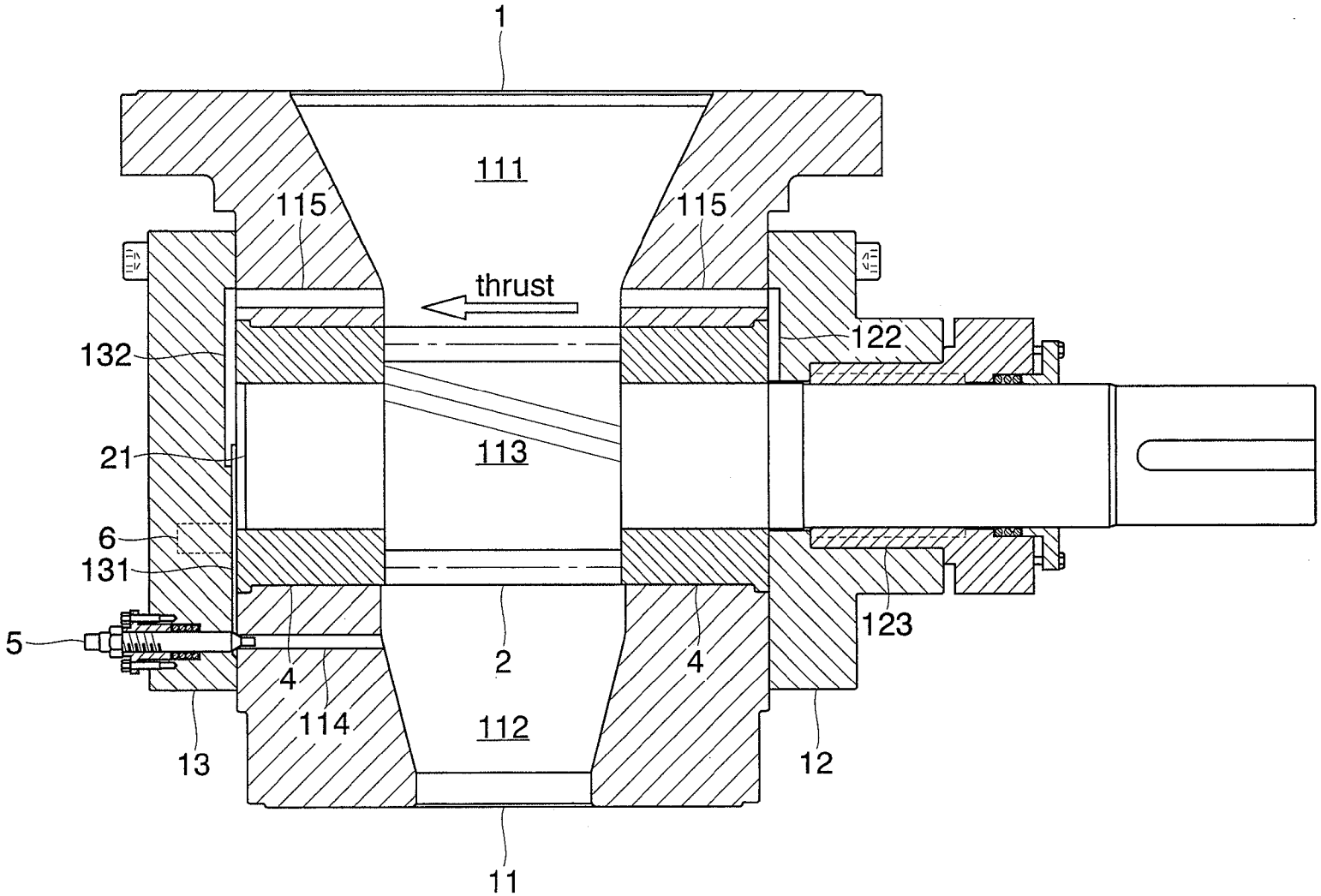
FIG. 1 is a sectional side elevation showing a gear pump according to one embodiment of the present invention.
Figure 2:
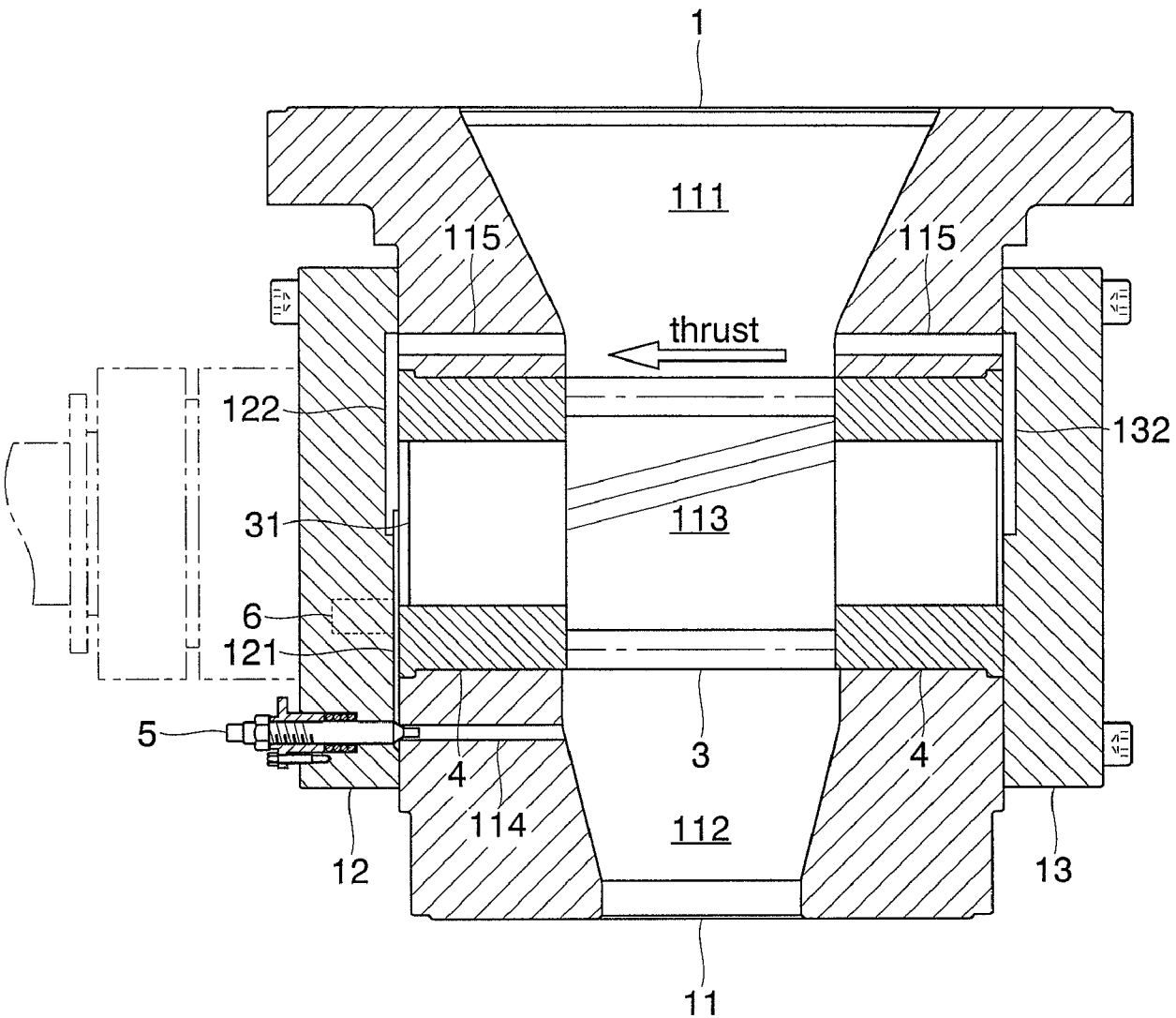
FIG. 2 is a sectional side elevation showing the gear pump.
Figure 3:
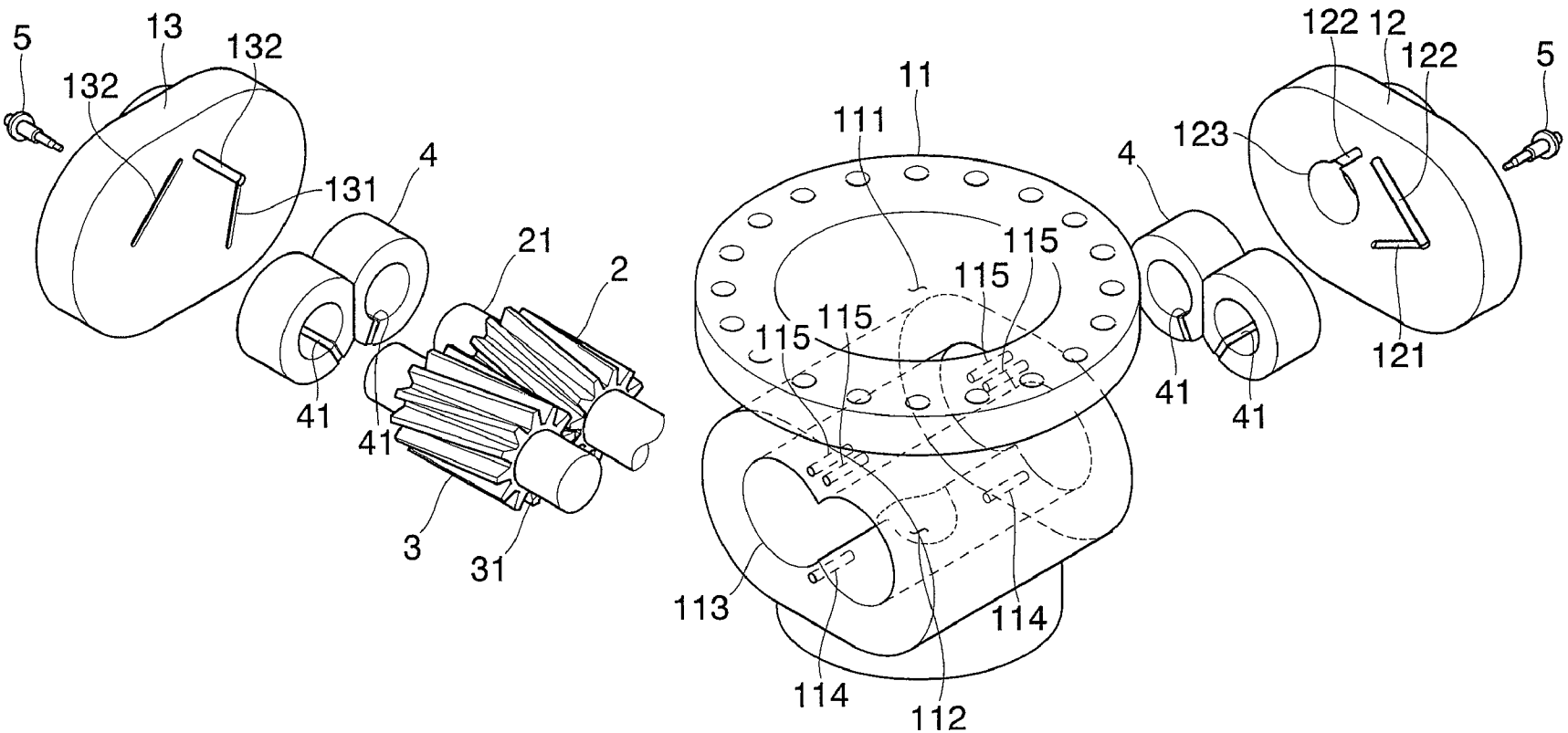
FIG. 3 is an exploded perspective view showing the gear pump.

Hereinafter, one embodiment of the present invention will be described with reference to the drawings. FIGS. 1 to 3 show a gear pump according to the present embodiment for use in delivering molten resins, other high polymers or the like with a high pressure in, for example, a petroleum plant, chemical plant, or the like. The gear pump is a so-called external gear pump having a driving gear 2 and a driven gear 3 which mesh with each other and are disposed within an internal space defined by a casing 1. The two gears 2 and 3 rotate to move a fluid caught in their tooth spaces from a suction side toward a discharge side, thereby performing a pumping action. Actually, the gear pump is positioned with its suction side and discharge side oriented upward and downward, respectively, while a tank storing molten resin or the like therein installed just above a suction opening of the gear pump. The gear pump sucks the molten resin or the like from the tank and discharges it from a discharge opening 112 at a required discharge pressure.

The casing 1 comprises, as constituents thereof, a body 11, a front cover 12, and a rear cover 13. The body 11 defines a spectacle bore 113 extending therethrough in the forward and rearward directions for accommodating therein the gears 2 and 3, gear shafts 21 and 31, and bearings 4. Specifically, the bearings 4 are positioned at the front and rear ends of the spectacle bore 113 to support the gear shafts 21 and 31 for rotation, while the gears 2 and 3 positioned between the opposed end faces of the two bearings 4. Each of the bearings 4 has an outside shape such that two substantially cylindrical bodies are joined together in a juxtaposed fashion so as to match the inner peripheral shape of the spectacle bore 113. The suction opening 111 and the discharge opening 112 which are oriented upwardly and downwardly, respectively, of the body 11 communicate with the spectacle bore 113. With the positioning thus made, the front cover 12 and the rear cover 13 are fitted on the opposite sides of the body 11 to close the spectacle bore 113. The front cover 12 is pierced to form a shaft hole 123 for a front end portion of the gear shaft 21 of the driving gear 2 (to be coupled to a motor for rotating the gears 2 and 3) to be inserted thereinto.

The driving gear 2 and the driven gear 3 are helical gears. However, there is no particular limitation on the tooth form of the gears 2 and 3. The tooth form may be an involute tooth form or other type of tooth form, for example, a single-point continuous contact tooth form which does not give rise to the confinement phenomenon, such as a shimacloid. The gears 2 and 3 may be formed integrally or not integrally with their respective gear shafts 21 and 23.

According to the present embodiment, the gear pump having the above-described construction is configured to apply shaft ends of the gear shafts 21 and 31 with a fluid pressure counterbalancing axial thrusts produced by the driving and driven gears 2 and 3, to cancel the axial thrust.

Specifically, the casing 1 is provided with introduction paths 121 and 131 for introducing a high-pressure fluid from the discharge side toward shaft end sides of the gear shafts 21 and 31 to balance the fluid pressure of the fluid introduced through the introduction paths 121 and 131 with the axial thrusts. When the gears 2 and 3 rotate, the driving gear 2 produces a rearwardly directed axial thrust. The introduction path 131 in the form of a bottomed groove is formed in an inside surface of the rear cover 13, i.e., a forwardly oriented surface of the rear cover 13 which faces a rearwardly oriented surface of the body 11, to allow the fluid to flow thereinto, so that the rear shaft end face of the gear shaft 21 is pressed by the pressure of the fluid flowing into the introduction path 131 against the rearwardly directed axial thrust. As well, the driven gear 3 produces a forwardly directed axial thrust. The introduction path 121 in the form of a bottomed groove is formed in an inside surface of the front cover 12, i.e., a rearwardly oriented surface of the front cover 12 which faces a forwardly oriented surface of the body 11, to allow the fluid to flow thereinto, so that the front shaft end face of the gear shaft 31 is pressed by the pressure of the fluid flowing into the introduction path 121 against the forwardly directed axial thrust.

The introduction paths 121 and 131 each extend from a point located outside the tip circle of a respective one of the gears 2 and 3 toward a point located adjacent to the shaft end face of a respective one of the gear shafts 21 and 31. The shaft end face of each gear shaft 21,31 is positioned slightly inwardly from the end face of a respective one of the bearings 4 that is located on the side opposite away from the gears 2 and 3. Thus, the fluid introduced through each introduction path 121,131 is allowed to flow into a respective one of the bearings 4 and press the associated shaft end face. The introduction paths 121 and 131 have to communicate with the discharge side of the pump. In the example shown, communication is provided between the introduction path 121,131 and the discharge side by providing a shunting path 114 which extends through a partition wall present between the discharge opening 112 and the rearwardly or forwardly oriented surface of the body 11 and terminates so as to be open to the introduction path 121,131.

Each of the bearings 4 is provided at its inner periphery with a slot 41 which allows some amount of the fluid to flow into the bearing 4 for lubricating the interface between the gear shaft 21,31 and the bearing 4. Each of the slots 41 is open at the end face of each bearing 4 on the side facing the gears 2 and 3 while extending along the axis to a point adjacent the end face of each bearing 4 on the side opposite away from the gears 2 and 3. Thus, each slot 41 is capable of allowing fluid caught in the tooth spaces of the gears 2 and 3 to partially flow into each bearing 4.

The fluid introduced to the shaft end sides through the introduction paths 121 and 131 and the fluid introduced into the bearings 4 through the slots 41 are eventually returned to the suction side of the pump. For this purpose, the inside surfaces of the rear cover 13 and front cover 12 are formed with respective return paths 122 and 132 each in the form of a bottomed groove. The return paths 132 and 122 of respective of the rear cover 13 and front cover 12 each comprise two return paths in a substantially V-shaped form corresponding to the respective gear shafts 21 and 31. The return paths 122 and 132 each extend from points located adjacent to the associated shaft end face of the gear shafts 21 and 31 toward a predetermined point located outside the tooth circle of the gears 2 and 3. Further, one of the two paths forming each of the return paths 122 and 132 is continuous with a respective one of the introduction paths 121 and 131. The return paths 122 and 132 have to be in communication with the suction side of the pump. In the example shown, communication is provided between each of the return paths 122 and 132 and the suction side by providing confluence paths 115 each of which extends through a partition wall present between the inner periphery of the suction opening 111 and the forwardly or rearwardly oriented face of the body 11 and terminates in an open end which is open to the associated one of the return paths 122 and 132. Assume that: the theoretical torque of the gear pump is $T_{th}$; the required torque of the gear pump is $T_s$; the efficiency of the gear pump is $\eta$; the discharge rate of the gear pump per rotation of the gears 2 and 3 is $V_{th}$; the outer diameter of the gear 2,3 is D; the facewidth of the gear 2,3 is B; the module of the gear 2,3 is M; the number of teeth of the gear 2,3 is Z; the pitch diameter of the gear 2,3 is A; the helix angle of the helical gear 2,3 is $\beta$; the differential pressure between the suction pressure and the discharge pressure is P; and the axial thrust produced by the gear 2,3 is F. The required torque $T_s$ is expressed as $T_{th}/\eta$; stated otherwise, the required torque $T_s$ is the sum of the theoretical torque $T_{th}$ and the torque loss. For the theoretical torque $T_{th}$, $$T_{th}=V_{th}\times P/2/\pi$$

holds. For the discharge rate $V_{th}$, $$V_{th}\fallingdotseq 2\pi\times M^2\times Z\times B$$

holds. The axial thrust F can be determined from the required torque $T_s$.

$$F=T_s\times A\times\tan\beta.$$

As can be seen from the above expressions, the axial thrust F is proportional to the differential pressure P.

When consideration is given only to the fluid flowing into each bearing 4 through the slot 41 for lubrication, it is a general practice to set the fluid pressure exerted on the associated shaft end side of the gear shaft 21,31 slightly higher than the suction pressure. When the inside diameter or inside dimension of the return path 122,132 and the confluence path 115 is established appropriately on the precondition that the axial thrust produced by the gear 2,3 is proportional to the differential pressure, the adverse effect of the axial thrust can be eliminated or reduced by balancing the pressure of fluid introduced from the discharge side with the axial thrust.

However, the axial thrust estimated in the designing stage often does not match the axial thrust actually produced because the apparent viscosity of a non-Newtonian fluid, such as a high polymer, varies with varying shear rate. For this reason, it is true that the gear pump is desirably configured to allow the fluid pressure introduced from the discharge side to be adjusted during actual operation using a real fluid.

The gear pump according to the present embodiment is provided with regulating valves 5 for regulating the pressure of fluid passing through the shunting paths 114 and the introduction paths 121 and 131, and pressure gauges 6 for measuring the fluid pressure. The regulating valve 5 is, for example, a manually operated valve configured to expand and retract a spool (i.e., valve body) by a feed screw. In the example shown, the regulating valve 5 is mounted on each of the rear cover 13 and the front cover 12. The spool of the regulating valve 5 is formed with a tapered portion which has decreasing diameter as it extends toward its tip. The fluid pressure can be increased or decreased by bringing the tapered portion into close contact with the opening (valve seat) of each shunting path 114 to fully close the opening or separating the tapered portion apart from the opening of the shunting path 114. The pressure gauge 6 is also mounted on each of the rear cover 13 and the front cover 12. There is no particular limitation on the type, system and the like of the pressure gauge 6.

According to the present embodiment, the gear pump for moving the fluid from the suction side toward the discharge side by rotation of the helical gears 2 and 3 meshing with each other, includes the introduction paths 121 and 131 for introducing the fluid from the discharge side toward shaft end sides of the gear shaft 21 and 31 to apply the shaft ends of the gear shaft 21 and 31 with a fluid pressure counterbalancing the axial thrusts produced by the helical gears 2 and 3. This construction can eliminate or reduce the adverse effect of the axial thrust irrespective of the helix angle. Since a helix angle design freedom is secured, the helix angle can be set to an appropriate value to avoid the confinement phenomenon as well as to meet various specifications and conditions. Thus, it becomes possible to realize a gear pump which is suitable for delivering high-pressure and high-viscosity fluids, by using the helical gears 2 and 3.

Since the gear pump further comprises the regulating valves 5 and pressure gauges 6 for regulating and measuring the pressure of fluid passing through the introduction paths 121 and 131, it is possible to regulate the fluid pressure to a necessary and sufficient value for canceling the axial thrusts by operating the regulating valves 5 while monitoring the fluid pressure. Since the axial thrust is proportional to the differential pressure, once adjustment is made to the regulating valves 5 under a certain operating condition, there is no need to readjust the regulating valves 5 even when the operating condition changes thereafter. That is, there is no need to perform any troublesome adjustment during operation of the pump.

Since the gear 2,3 and its associated gear shaft 21,31 are formed into a single member, the pump can be reduced in size.

The gear pump has the feature that: the return paths 121 and 131 are provided for returning the fluid introduced to the shaft end sides through the introduction paths 121 and 131 toward the suction side; and each of the bearings 4 supporting the gear shafts 21 and 31 is formed with the slot 41 in communication with the associated one of the return paths 122 and 132 and the associated one of the introduction paths 121 and 131 for allowing the fluid to flow into the inner periphery of the bearing 4 for lubrication. This feature makes it possible to bring the fluid pressure and the axial thrust into balance and lubricate the bearing 4 at the same time.

The casing 1 of the gear pump comprises, as constituents thereof, the body 11 having a bore extending therethrough axially of the gear shafts 21 and 31 for accommodating the helical gears 2 and 3, the gear shafts 21 and 31 and the bearings 4 therein, and the front and rear covers 12 and 13 closing the body 11 at front and rear sides thereof and each having an inside surface opposed to the associated shaft end of the gear shaft 21,31, wherein the inside surface of each of the front and rear covers 12 and 13 is formed with the introduction path 121,131 and the return paths 122,132. This feature fails to incur too much complication of the pump structure. Further, this feature allows the regulating valve 5 and the pressure gauge 6 to be mounted on each of the front and rear covers 12 and 13, thereby contributing to simplification of the pump assembling process.

The present invention is not limited to the embodiment specifically described above. Particularly, applications of the present invention are not limited to pumps for delivering high-pressure and high-viscosity fluids with pressure. The present invention is applicable to any pump which employs a helical gear.

Specific structures of the components of the gear pump are not limited to the foregoing embodiment and can be variously modified without departing from the concept of the present invention.

The invention claimed is:

1. A gear pump for moving a fluid from a suction side toward a discharge side by rotation of helical gears meshing with each other, comprising:

a casing including a body, a front cover, and a rear cover;

the body accommodating the helical gears and first and second gear shafts, the front cover and the rear cover closing the body at front and rear sides thereof respectively, an inside surface of the front cover facing the forwardly oriented face of the body opposite to a shaft end side of each of the gear shafts, and an inside surface of the rear cover facing the rearwardly oriented face of the body opposite to a shaft end side of each of the gear shafts;

the inside surface of the rear cover includes a first introduction path formed as a bottomed groove and a first return path formed as a bottomed groove, the first introduction path extends to a rear shaft end face of the first gear shaft to communicate with a discharge opening, and a pressure of fluid flowing into the first introduction path, as a pressure against the axial thrust of the first gear shaft, is applied with the rear shaft end face of the first gear shaft, and the first return path communicates with a suction opening and is continuous with the first introduction path; and the inside surface of the front cover includes a second introduction path formed as a bottomed groove and a second return path formed as a bottomed groove, the second introduction path extends to a front shaft end face of the second gear shaft to communicate with the discharge opening, and a pressure of fluid flowing into the second introduction path, as a pressure against the axial thrust of the second gear shaft, is applied with the front shaft end face of the second gear shaft, and the second return path communicates with the suction opening and is continuous with the second introduction path.

2. The gear pump according to claim 1, further comprising a regulating valve for regulating a fluid pressure of the fluid passing through an associated one of the introduction path.

3. The gear pump according to claim 2, further comprising a pressure gauge for measuring the fluid pressure of the fluid passing through the associated one of the introduction paths.

4. The gear pump according to claim 3, wherein each of the helical gears is formed integrally with its associated gear shaft.

5. The gear pump according to claim 3, wherein:

the return paths are provided for returning the fluid introduced to the shaft end sides through the introduction paths toward the suction side; and each of bearings supporting the gear shafts is formed with a slot in communication with an associated one of the return paths or an associated one of the introduction paths for allowing the fluid to flow into an inner periphery of the bearing for lubrication.

6. The gear pump according to claim 2, wherein each of the helical gears is formed integrally with its associated gear shaft.

7. The gear pump according to claim 2, wherein:

the return paths are provided for returning the fluid introduced to the shaft end sides through the introduction paths toward the suction side; and each of bearings supporting the gear shafts is formed with a slot in communication with an associated one of the return paths or an associated one of the introduction paths for allowing the fluid to flow into an inner periphery of the bearing for lubrication.

8. The gear pump according to claim 1, wherein each of the helical gears is formed integrally with its associated gear shaft.

9. The gear pump according to claim 8, wherein:

the return paths are provided for returning the fluid introduced to the shaft end sides through the introduction paths toward the suction side; and each of bearings supporting the gear shafts is formed with a slot in communication with an associated one of the return paths or an associated one of the introduction paths for allowing the fluid to flow into an inner periphery of the bearing for lubrication.

10. The gear pump according to claim 1, wherein:

return paths are provided for returning the fluid introduced to the shaft end sides through the introduction paths toward the suction side; and each of bearings supporting the gear shafts is formed with a slot in communication with an associated one of the return paths or an associated one of the introduction paths for allowing the fluid to flow into an inner periphery of the bearing for lubrication.

* * * * *